US007287349B1

(12) United States Patent
MacDonald et al.

(10) Patent No.: US 7,287,349 B1
(45) Date of Patent: Oct. 30, 2007

(54) LOW SPEED ELECTRIC VEHICLE MOBILE ADVERTISING SYSTEM

(75) Inventors: Luis D. MacDonald, Baltimore, MD (US); Randy M. Perry, Woodstock, MD (US)

(73) Assignee: Autoflex, Inc., Baltimore, MD (US)

( * ) Notice: Subject to any disclaimer, the term of this patent is extended or adjusted under 35 U.S.C. 154(b) by 352 days.

(21) Appl. No.: 11/104,458

(22) Filed: Apr. 13, 2005

(51) Int. Cl.
*G09F 21/04* (2006.01)

(52) U.S. Cl. ..... 40/591; 40/610; 40/592; 40/606.14; 40/590; 40/588; 40/606.15; 40/606.16; 296/21

(58) Field of Classification Search ..... 40/610, 40/606.14, 606.15, 606.16, 590, 591, 592, 40/588; 296/21
See application file for complete search history.

(56) References Cited

U.S. PATENT DOCUMENTS

| | | | | | |
|---|---|---|---|---|---|
| 1,481,703 | A | | 1/1924 | Forbes et al. | |
| 1,597,112 | A | | 8/1926 | Rymal | |
| 1,597,262 | A | | 8/1926 | Bloodgood | |
| 1,633,635 | A | | 6/1927 | Harmon et al. | |
| 1,973,276 | A | | 9/1934 | Bard | |
| 2,530,525 | A | | 11/1950 | Howenstine | |
| 2,753,640 | A | | 7/1956 | McConnell | |
| 3,054,205 | A | | 9/1962 | Sierpin | |
| 3,242,329 | A | | 3/1966 | Abrams | |
| 3,305,961 | A | | 2/1967 | Lanzon et al. | |
| 3,702,033 | A | * | 11/1972 | Coleman | 40/541 |
| 3,798,814 | A | * | 3/1974 | Harmon | 40/590 |
| 3,802,103 | A | * | 4/1974 | Neff | 40/591 |
| 4,052,806 | A | | 10/1977 | George | |
| 4,077,144 | A | * | 3/1978 | Smits | 40/590 |
| 4,152,854 | A | * | 5/1979 | Berry et al. | 40/610 |
| 4,346,529 | A | | 8/1982 | Keller | |
| 4,475,299 | A | | 10/1984 | Nelson | |
| 4,557,517 | A | | 12/1985 | Bolduc et al. | |
| 4,580,361 | A | | 4/1986 | Hillstrom et al. | |
| 4,688,343 | A | | 8/1987 | Allan | |
| 4,756,107 | A | | 7/1988 | Hillstrom | |
| 4,976,485 | A | * | 12/1990 | Jonckheere | 296/26.15 |
| 5,005,893 | A | | 4/1991 | McCrary | |
| 5,083,826 | A | | 1/1992 | McCrary | |
| 5,084,994 | A | | 2/1992 | Elmer | |
| 5,210,970 | A | | 5/1993 | Elmer | |
| 5,249,833 | A | | 10/1993 | Kobayashi | |
| 5,310,209 | A | * | 5/1994 | Holman | 280/656 |
| 5,339,551 | A | | 8/1994 | Elmer | |

(Continued)

FOREIGN PATENT DOCUMENTS

WO PCT/SE85/00345 3/1986

*Primary Examiner*—Lesley D. Morris
*Assistant Examiner*—Shin Kim
(74) *Attorney, Agent, or Firm*—Rosenberg, Klein & Lee

(57) ABSTRACT

This system comprises a small advertising assembly that can be easily mounted onto the bed of a Low-Speed Electric Vehicle. The assembly includes an advertising display and a frame. The system allows for the advertising display to be attached in multiple positions such as: upright for viewing and stowed flat for transport. The advertising display has an internal light source and removable translucent advertising panels. This Low Speed Electric Vehicle Mobile Advertising System provides an advertising system that is mobile for both on- and off-road conditions, generates little or no noise or air pollution, and operates at pedestrian-friendly speeds to promote maximum exposure of the message being advertised.

20 Claims, 9 Drawing Sheets

U.S. PATENT DOCUMENTS 5,379,540 A 1/1995 Howard
5,542,203 A * 8/1996 Luoma et al. ..... 40/610
5,669,470 A 9/1997 Ross
5,887,931 A 3/1999 Bills et al.
5,918,924 A 7/1999 Cowan
6,036,250 A 3/2000 Glatter
6,119,384 A * 9/2000 Fischer ..... 40/606.02
6,145,230 A 11/2000 Holmberg
6,421,600 B1 7/2002 Ross
6,804,904 B2 * 10/2004 Garcia ..... 40/590
6,817,125 B2 * 11/2004 Chatterjea ..... 40/611.02
7,107,714 B2 * 9/2006 Evans et al. ..... 40/610

* cited by examiner

LOW SPEED ELECTRIC VEHICLE MOBILE ADVERTISING SYSTEM

BACKGROUND OF INVENTION

1. Field of the Invention

The invention relates to a mobile advertising display system. More specifically, it is directed to an advertising system mounted reconfigurably onto the bed of a Low-Speed Electric Vehicle.

2. Related Art

Mobile advertising systems on gasoline or diesel vehicles are known in the art, as are towable illuminated signs. Additionally, cartop, rear, or window mounted signs are known in the art.

The best prior art known to Applicants include U.S. Pat. Nos. 1,481,703; 1,597,112; 1,597,262; 1,633,635; 1,973,276; 2,530,525; 2,753,640; 3,054,205; 3,242,329; 3,305,961; 3,702,033; 3,802,103; 4,052,806; 4,346,529; 4,475,299; 4,557,517; 4,580,361; 4,688,343; 4,756,107; 5,005,893; 5,083,826; 5,084,994; 5,210,970; 5,249,833; 5,339,551; 5,379,540; 5,669,470; 5,887,931; 5,918,924; 6,036,250; 6,145,230; and, 6,421,600. The prior art known to Applicants also include PCT Application #PCT/SE85/00345.

Mobile advertising on vehicles such as trailers, semi-trailers, pick-up trucks, vans, and taxis or cartops has long been available. While advertising billboards mounted on such larger gasoline or diesel powered vehicles are ideal for highways and other roads, their size, speed, and inherent noise and air pollution make them unpractical or unwelcome in many venues. With the increasingly affordable, reliable, and advancing technology of electric vehicles complying with the federal safety standards established in 40 C.F.R. 571.500 for example (interchangeably termed "low-speed vehicles (LSV)," "alternative fueled vehicles (AFV)," "electric vehicles (EV)," or "zero-emission vehicles"), a need exists to effectively utilize such low or zero-emission vehicles for mobile advertising.

An LSV may be any four-wheeled electric vehicle with a top speed of greater than 20 mph but not greater than 25 mph. An advertising system mounted on the bed of such small, quiet, zero-emission utility LSV may be moved easily through areas with posted speed limits of 35 or below. In accordance with one aspect of the present invention, there is provided a mobile advertising system capable of effectively targeting a wide range of areas such as high-density urban streets, historic districts and areas, conventions, tourist sites, parks, beaches, boardwalks, stadiums, parking lots, campuses, retirement villages, resorts, tradeshows, fairs, and the like.

In addition, the pedestrian speed limits and open design of these LSVs allow close interaction with the public, readily facilitating such activities as information or sample distribution for example, to a degree unparalleled with larger truck, van, or car-mounted advertising. While trucks, vans, and cars can and sometimes are used to distribute samples and information when stationary, they rarely have the leeway and flexibility to actually be driven through an area wherever people may gather and/or to pull off-road at whim responsive to the hail of passersby.

Under pressure of federal and state laws, businesses and government agencies are seeking ways to employ low or zero-emission vehicles in their fleets and daily operations. The combination of its zero-emission motor and neighborhood friendly design makes the Low Speed Electric Vehicle Mobile Advertising System especially amenable for use by government agencies, for example, for public service messages which attract constituents and, as well, allow drivers or passengers to provide information, distribute informational material such as forms and service brochures, or to conduct contemporaneous polls and canvassing efforts.

SUMMARY OF INVENTION

It is an object of the present invention to provide an advertising system that is mobile both in on-road and off-road conditions.

It is another object of the present invention to provide a mobile advertising system including a platform that generates little or no noise or air pollution.

It is another object of the present invention to provide a mobile advertising system that operates at pedestrian-friendly speeds and promotes a high level of interaction as to a message being advertised.

It is another object of the present invention to provide an advertising display on a vehicle utility bed in reconfigurable manner for selective disposition in a plurality of configurations including upright operational and flat stowed configurations.

These and other objects are attained in a mobile advertising display system formed in accordance with the present invention. The system generally includes a mobile platform having a utility bed surface; a reconfigurable display assembly disposed on the mobile platform for displacement relative thereto between at least first and second positions; and, at least first and second coupling assemblies for releasably locking the display assembly to the mobile platform respectively in the first and second positions. The display assembly, which includes at least one replaceable display panel, maintains the display panel transversely upright on the utility bed surface in the first position, while in the second position maintains the display panel stowed in substantially overlaying manner over the utility bed surface.

At least one of the first and second coupling assemblies includes a flange portion extending from one of the display assembly and mobile platform, and a receptacle portion extending from the other of the display assembly and mobile platform for matedly receiving the flange portion. Such coupling assembly also includes first and second sleeve portions extending respectively from the display assembly and mobile platform for coaxially aligned securement one with the other.

In certain preferred embodiments of the system, the other of the first and second coupling assemblies includes an engagement portion extending from one of the display assembly and mobile platform for mated engagement with one of the flange and receptacle portions extending from the other of the display assembly and mobile platform. Each receptacle portion in certain embodiments is preferably formed to extend from the mobile platform, while the flange and engagement portions are each formed to extend from the display assembly. Preferably, the other of the first and second coupling assemblies further includes a mounting portion extending from one of the display assembly and mobile platform for fastener attachment to the other.

The display assembly in an exemplary embodiment preferably includes at least a pair of the display panels disposed on opposed sides thereof, each having a translucent portion; as well as a light source disposed between those display panels for illuminating each. The display assembly of that embodiment is preferably formed with a frame defining a pair of slotted track peripheral portions slidably receiving respective ones of the display panels through an open end, and a pair of retainer members detachably coupled to the frame for enclosing the open end. The retainer members respectively retain the display panels in the frame's peripheral portions.

DETAILED DESCRIPTION OF THE PREFERRED EMBODIMENTS

An exemplary embodiment of a Low-Speed Electric Vehicle Mobile Advertising System formed in accordance with the present invention generally comprises an electric low-speed vehicle (or LSV) 100 with a utility bed, and an advertising display, as shown in FIGS. 1-4.

Figure 1:
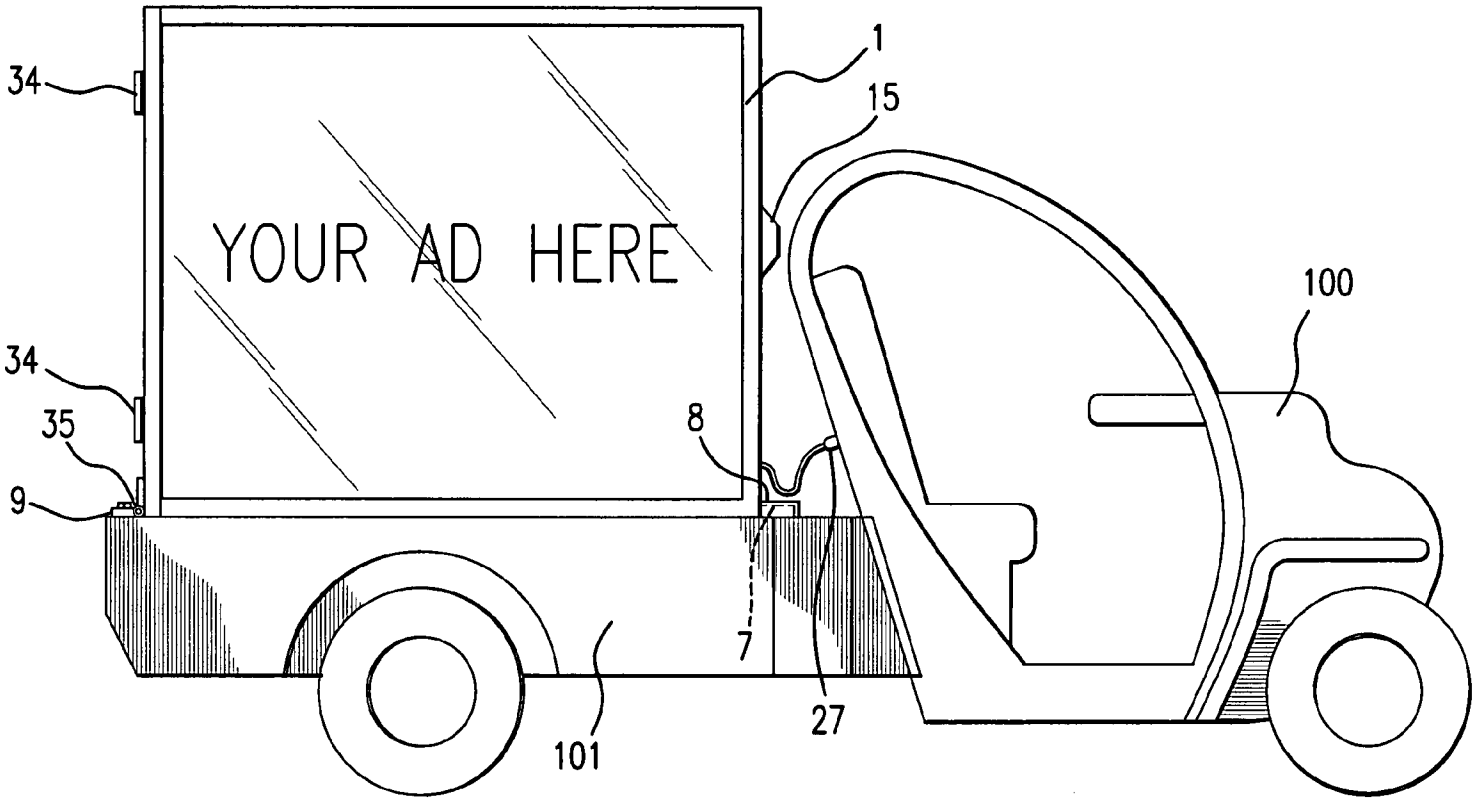
FIG. 1 is a schematic elevational view of one embodiment of the present invention, illustrating a display assembly thereof in an operational configuration.
Figure 2A:
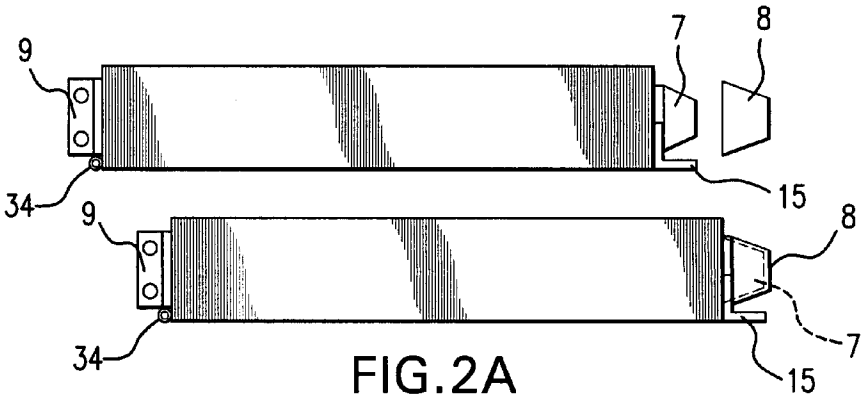
FIG. 2A are illustrative plan views of a portion of the embodiment as shown in FIG. 2.
Figure 1A:
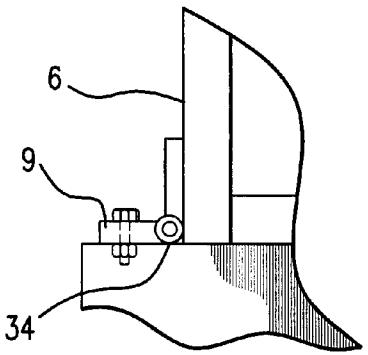
FIG. 1A is a detailed view, partially cut away, of a portion of the embodiment shown in FIG. 1.
Figure 2:
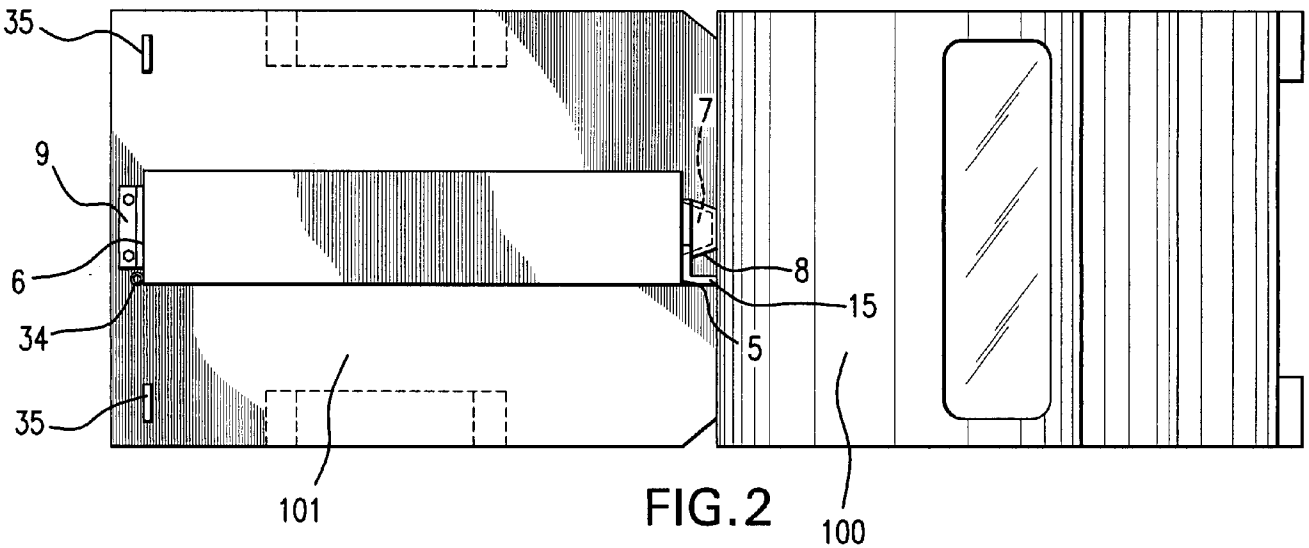
FIG. 2 is a schematic plan view of the embodiment shown in FIG. 1.
Figure 3:
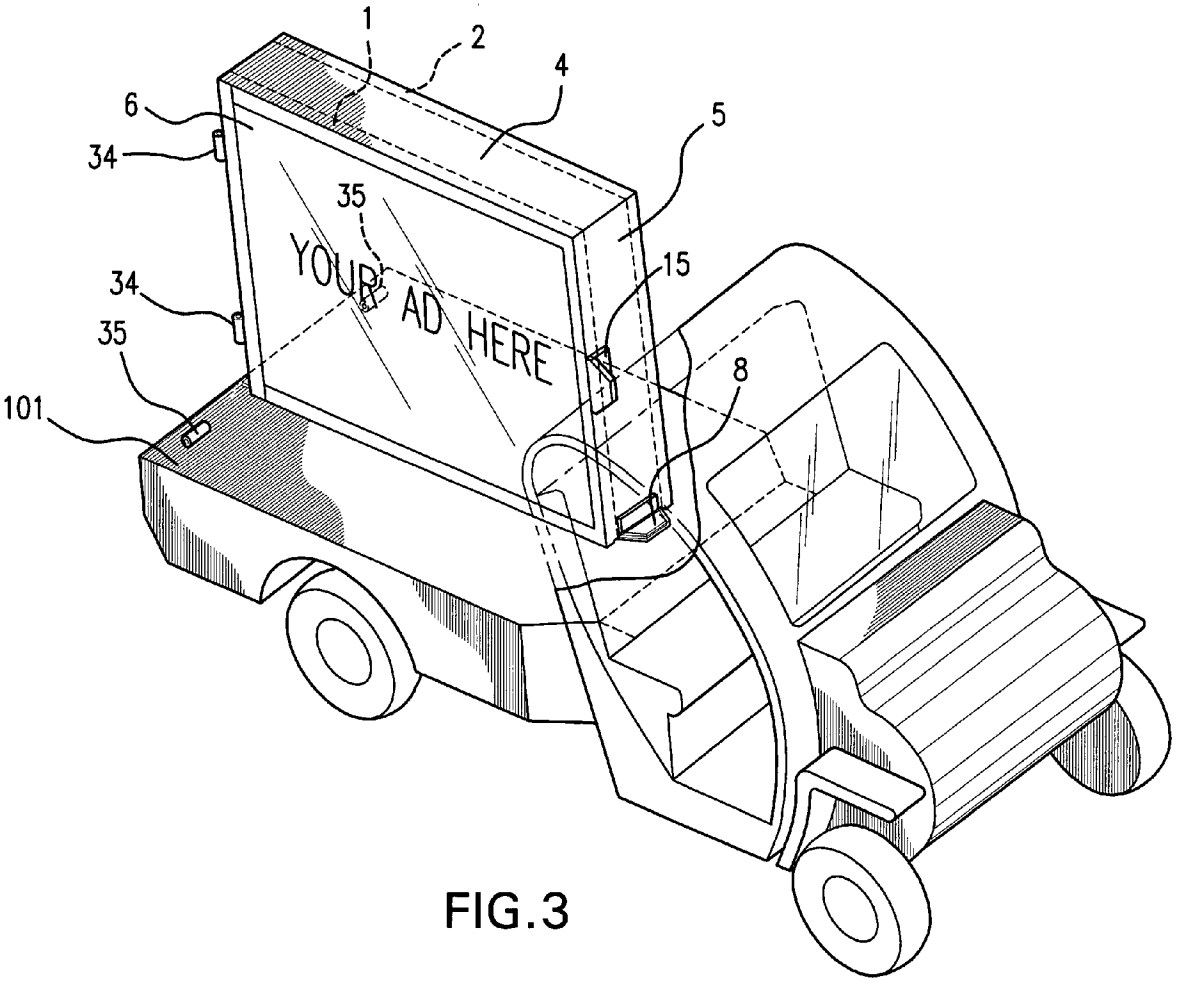
FIG. 3 is a schematic front perspective view of the embodiment shown in FIG. 1.
Figure 4:
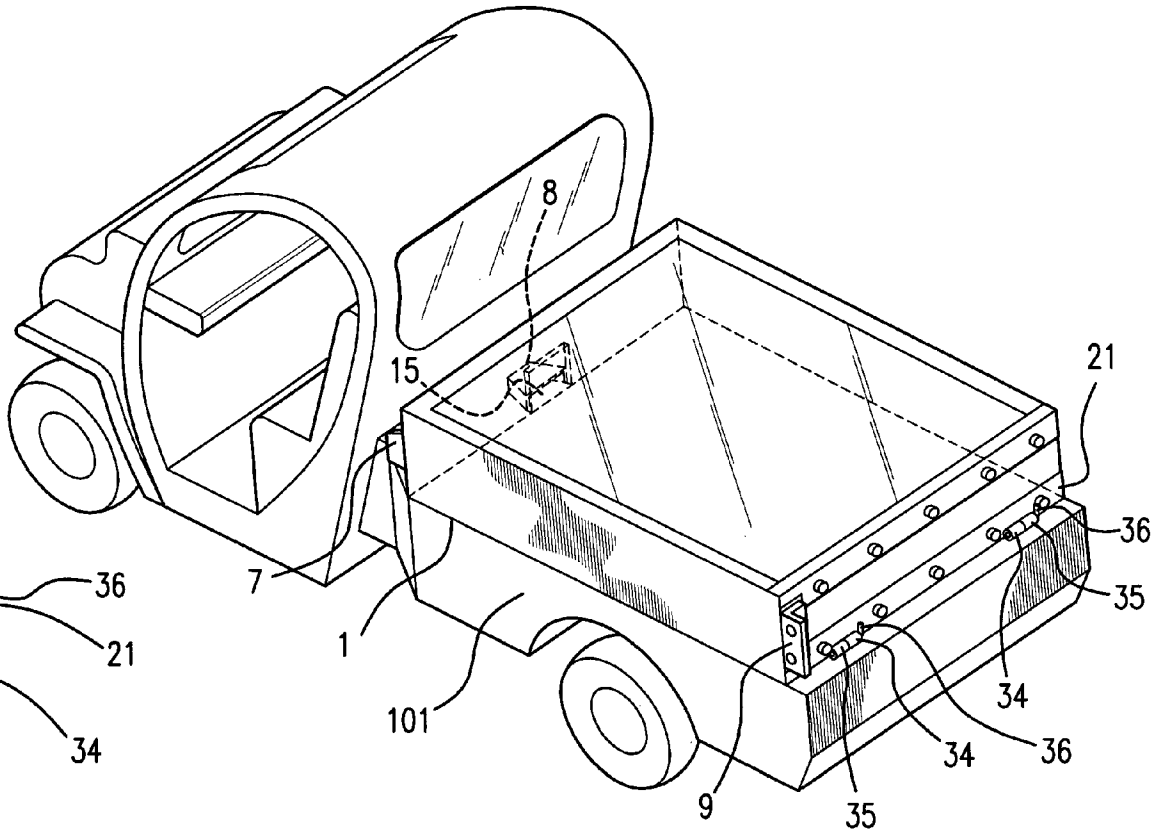
FIG. 4 is a schematic rear perspective view of the embodiment shown in FIG. 1, illustrating a display assembly thereof in a stowed configuration.

The advertising display affixes to the bed of the vehicle preferably in at least two configurations—upright to assume a viewing, or operational, position, as shown in FIGS. 1-3, and flat to assume a stowed configuration for transport, as illustrated in FIG. 4. Given the 25 mph top speed of the LSV in the exemplary embodiment shown, the Low-Speed Electric Vehicle Mobile Advertising System may be transported in many (though not necessarily all) applications be transported by means of a flatbed truck or towed trailer to the low-speed community where it will be operated. During such transport, while the advertising display is mounted flat, the sign panels and the frame are protected from road debris, dirt, and wind. Upon arrival at the advertising location, the advertising display is unfastened from the bed of the LSV and re-fastened in an upright position, such that an advertiser's message provided on the sign panels is visible.

An LSV 100 so equipped may be operated in both on-road and off-road settings, depending on the requirements of the given application. That is, the fully equipped LSV 100 may, where the application permits, be operated indoors, on walkways, on platforms and stages, and in other non-road settings in which typical street vehicles cannot adequately operate. Where conditions permit, the LSV 100 may, of course, also be operated on public roads. For example, the LSV 100 may be operated to commute to or from the sites of primary intended use, with advertising display equipment securely disposed in accordance with the present invention either in the stowed or upright (display) positions.

Frame

In its operational configuration for viewing, the advertising display preferably mounts upright to the bed of the vehicle by simple and inexpensive measures such as shown in FIGS. 1-2. At the lower end of the front panel 5 is preferably welded, or otherwise securely formed, a mounting flange 7 which inserts into a receptacle 8 provided (by welding or other suitable means) on the bed 101 of the LSV (FIG. 2). At the lower end of a back panel 6 is preferably welded a mounting bracket 9 (see FIGS. 1-2 for detailed views). To mount the advertising display onto the bed 101 of the LSV for viewing purposes, a mounting flange 7 provided at the lower end of a front panel 5 is inserted into a receptacle 8 provided on the bed 101 of the LSV as shown. The back end of the advertising display is secured to the bed 101 of the LSV by a mounting bracket 9 provided at the lower end of the back panel 6. Preferably, a bolt/nut arrangement removably fastens the mounting bracket 9 to the bed 101 of the LSV. It is to be understood that a sleeve and pin hinge or other suitable metal fastening measures known in the art may replace the mounting bracket 9 as long as they exhibit the same functionality of removably attaching the lower end of the back panel to the LSV bed 101.

The mounting flange 7 and mounting bracket 9 are configured with sufficient width and thickness dimensions that they provide ample support, both laterally and lengthwise, while the display assembly is positioned for use. Where necessary, a plurality of suitably configured mounting flanges 7 and mounting brackets 9 may be employed to ensure strength of support. Moreover, suitably configured mounting brackets may be provided along lower lengths of the frame assembly for reinforced lateral support, should the intended application so require.

During transport, the advertising display may be mounted flat to protect the sign panels as shown in FIG. 4. To secure the advertising display flat onto the bed 101 of the LSV, a mounting flange 15 welded or otherwise formed onto the retainer frame 1 is inserted into the corresponding receptacle 8 provided on the bed 101 of the LSV.

Figure 4A:
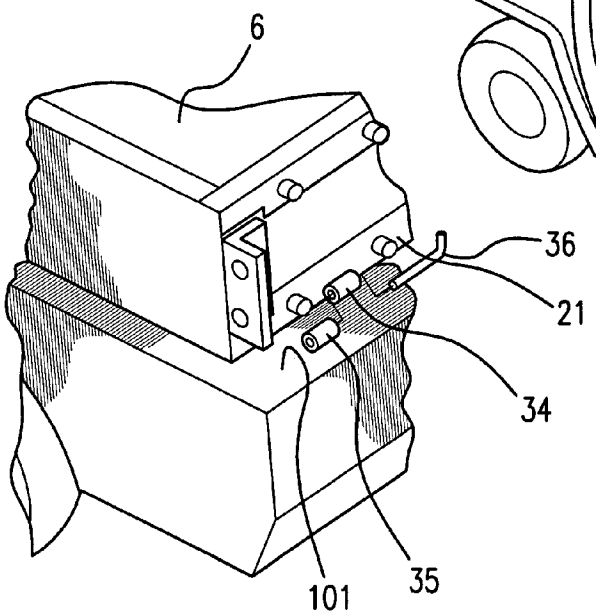
FIG. 4A is an exploded rear schematic view of a portion of the embodiment as shown in FIG. 4.

As shown in the detailed view of FIG. 4A, metal sleeves 34 welded or otherwise suitably provided on a sign retainer end 21 may be fastened by pins 36 or other suitable means known in the art to metal sleeves 35 welded or otherwise provided on the bed 101 of the LSV. It is to be understood that bolts or other suitable metal fastening measures known in the art may replace the sleeves and pin hinge measures shown, as long as they exhibit the same functionality of removably attaching the lower end of the back panel to the LSV bed 101.

Figure 5:
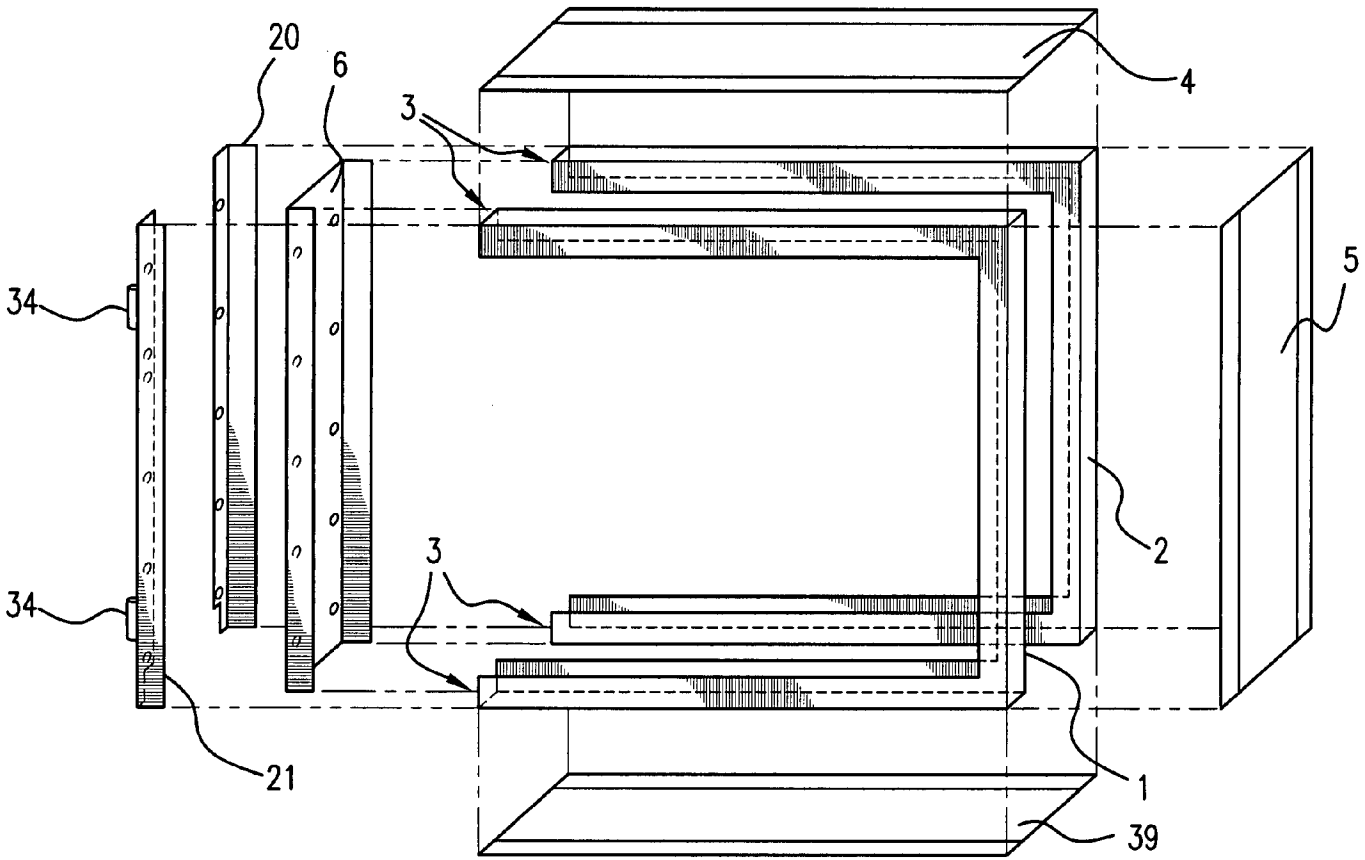
FIG. 5 is an exploded perspective view of a portion of the embodiment shown in FIG. 1.

FIG. 5 shows the frame assembly wherein all parts, excepting 6, 20, and 21, are preferably welded together to form the box frame for the advertising display. The advertising display frame includes frames 1 and 2 having a number of horizontal and vertical members. Integral to frames 1 and 2 is a track 3 that allows translucent panels of the signs to be inserted and held in place in the frame (see FIG. 8). The advertising display has structural panels, including a top panel 4, a front panel 5, a back panel 6, and a bottom panel 39. These structural panels 4, 5, 6, 39 are preferably wide enough to house a lighting array, but no wider than the bed 101 of the LSV.

Figure 6:
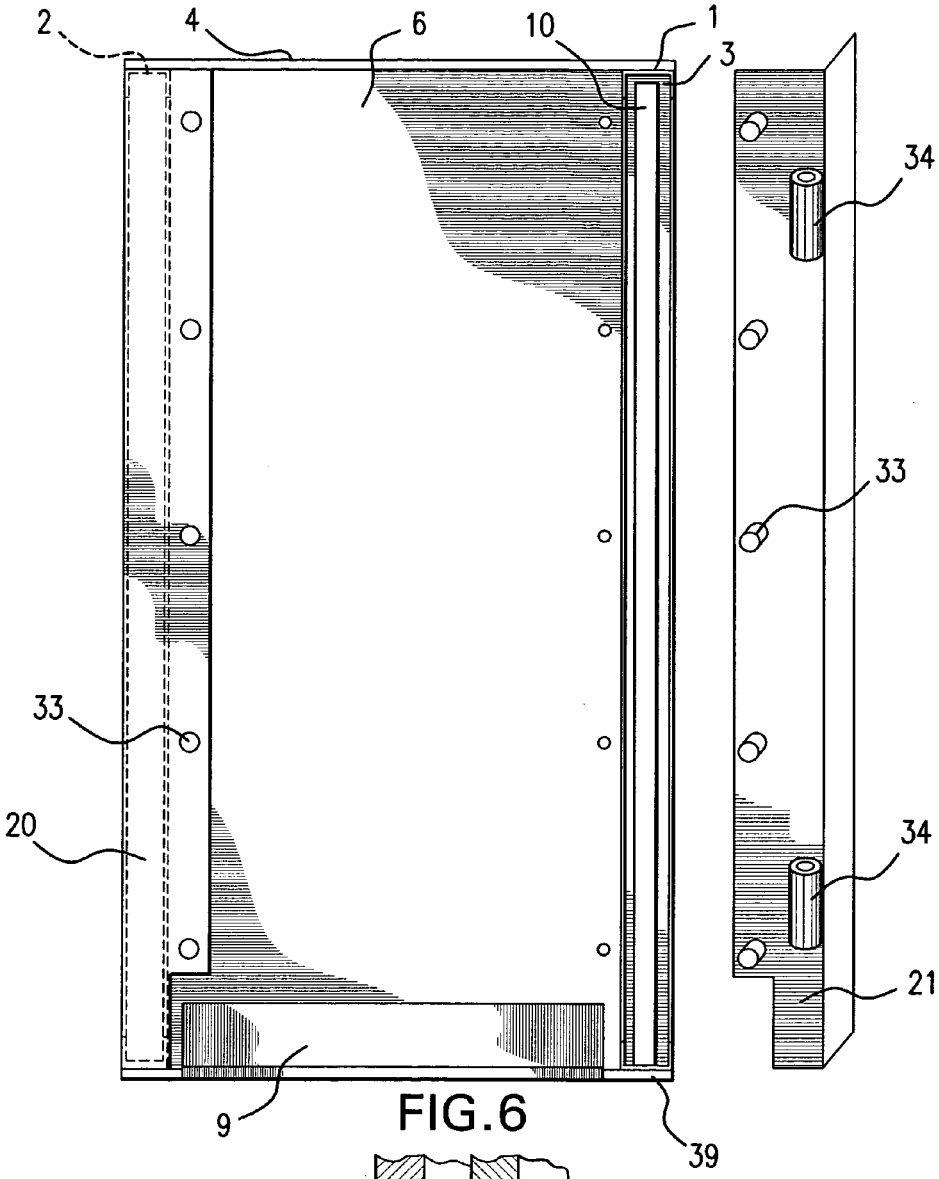
FIG. 6 is a rear partially exploded rear elevational view of the portion of the embodiment illustrated in FIG. 5.

These structural panels 4, 5, 6, 39 are fastened to the rectangular frames 1 and 2. FIG. 6 shows a portion of the advertising display (only) as if viewed from the rear end of the LSV. Sign retainer ends 20, 21 are shown attached to the back panel 6 by means of thumb screws 33 which screw through the retainer ends 20, 21 and through the back panel 6. The sign retainer end 21 is shown detached to reveal the corresponding holes through panel 6 into which the thumb screws are screwed.

Figure 6A:
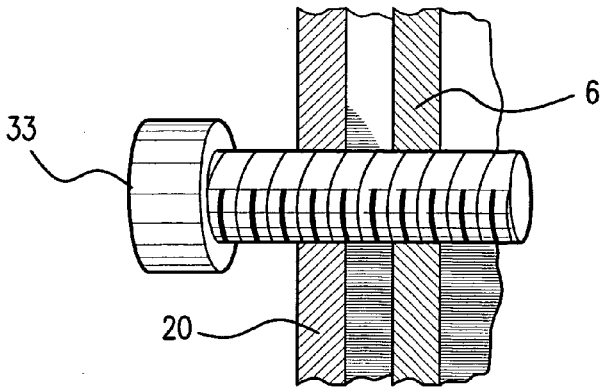
FIG. 6A is a detailed perspective view, partially cut away, of a part of the portion of the embodiment shown in FIG. 6, when fully assembled.

The detail shown in FIG. 6A further illustrates an exemplary embodiment employing a thumb screw fastening mechanism. The structural panels 4, 5, 6, 39, the frames 1 and 2, the sign retainer ends 20 and 21, the lighting mounts 26 and 28, the mounting flanges and brackets 7, 9, 15, and the receptacle 8 are all preferably made of aluminum or other similar strong, rustproof, relatively lightweight metal.

Advertising Display

The advertising display includes a frame assembly (as described above), sign panels, and a lighting array, as shown in FIGS. 5-9. FIG. 5 shows the metal frame, assembled as illustrated in FIGS. 6-9. The advertising display has sign panels 10 and 11 onto which advertising messages are affixed.

In one exemplary embodiment, these sign panels are made of a $3/16^{th}$ inch thick sheet of preferably translucent material (such as acrylic or polycarbonate, but any suitable material may be used), for instance, through which a lighting source backlights the translucent graphic message provided thereon. The sign panels 10 and 11 are inserted into the advertising display to engage tracks 3 integral to the frames 1 and 2. Preferably, the depth of each track 3 is slightly larger than thickness of the sign panel material, such that it may securely retain a sign panel therein (see FIGS. 6, 8-9). To allow access to the tracks 3, the sign retainer ends 20 and 21 of frames 1 and 2 are detachably coupled, preferably by means of thumb screws 33 or other fasteners that are easily manipulated as shown in FIG. 6. Thus, once the advertising display is mounted upright, the sign panels may be easily changed without tools.

Preferably, the display assembly is dimensioned such that when laid in the stowed position upon the LSV's flat bed, it remains peripherally within, and therefore fully supported by, the bed. This not only ensures support of the stowed assembly, it yields for the resulting configuration a neatly contained and aerodynamically stable profile.

Illumination

Figure 7:
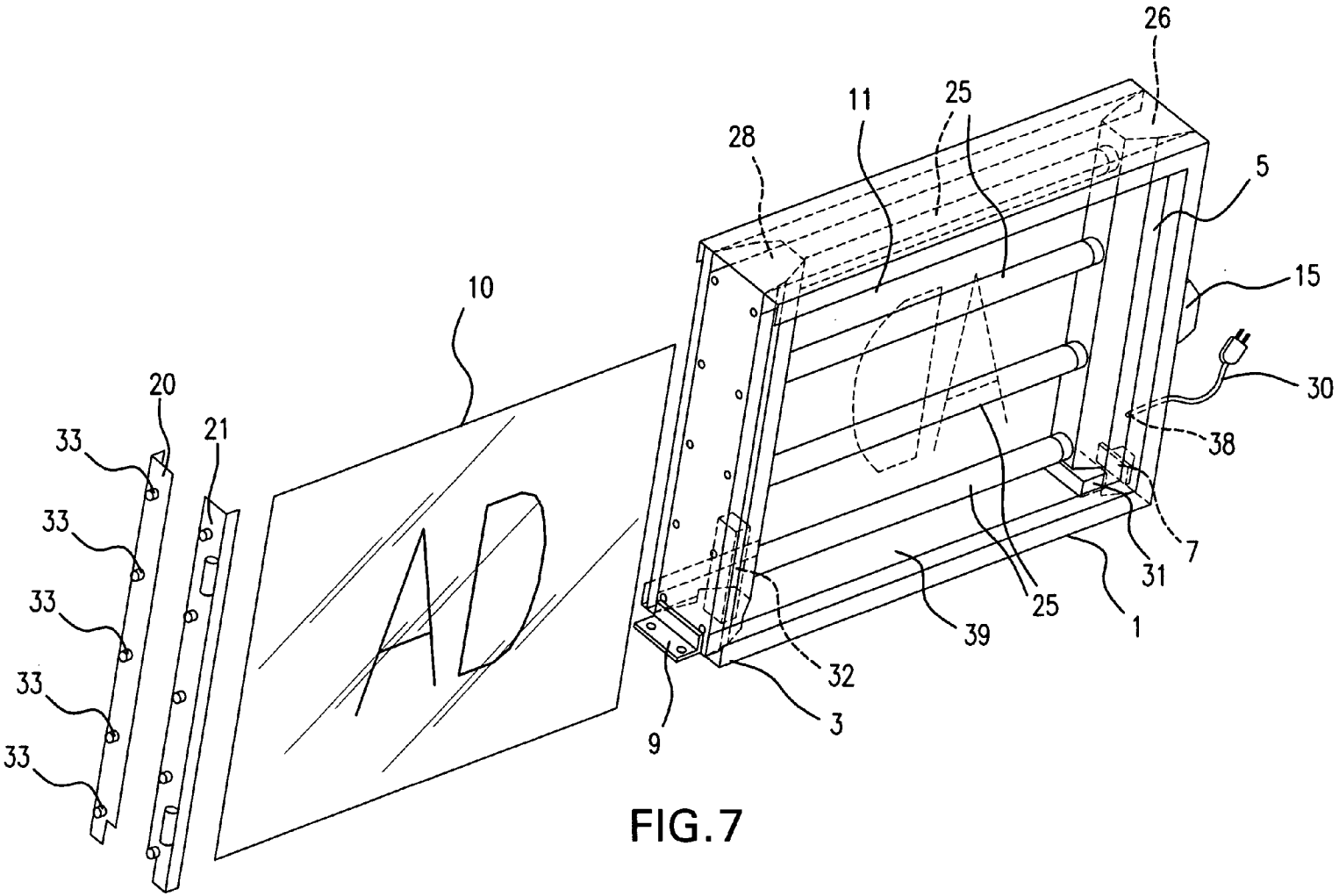
FIG. 7 is an exploded rear perspective view of a portion of the embodiment shown in FIG. 1.
Figure 8:
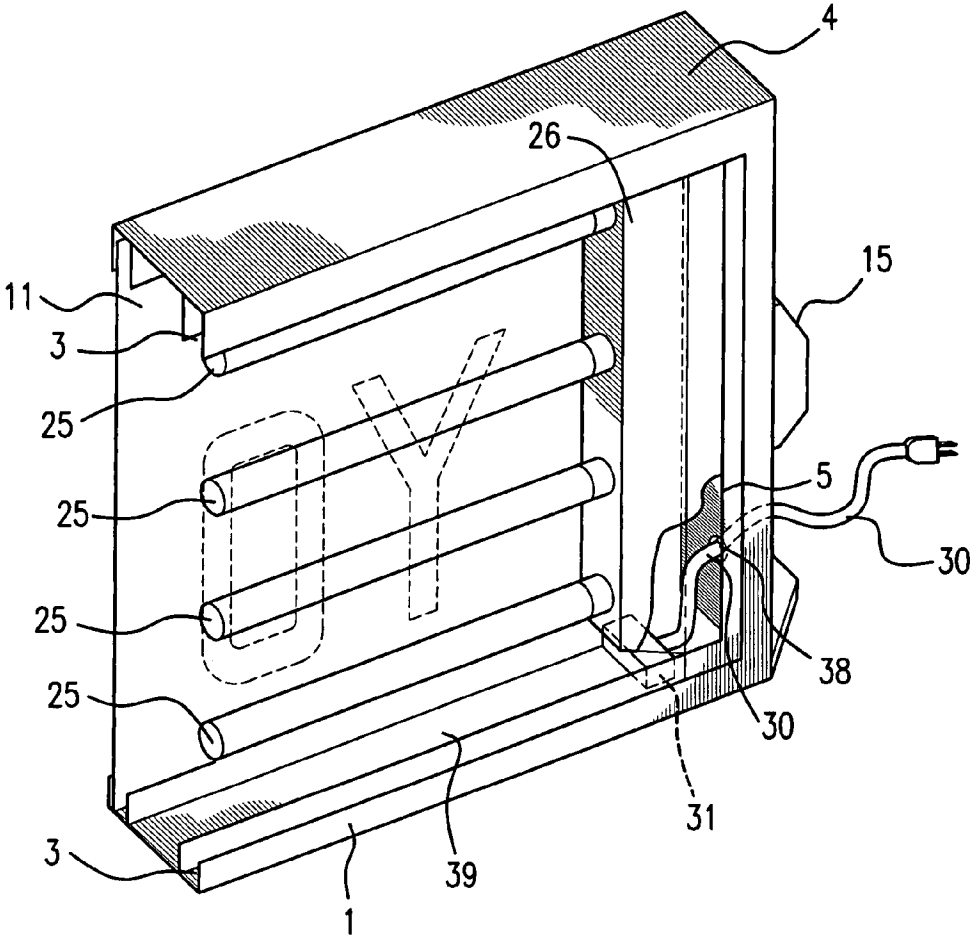
FIG. 8 is an illustrative perspective view, partially cut away, of a part of the portion of the embodiment shown in FIG. 7.
Figure 9:
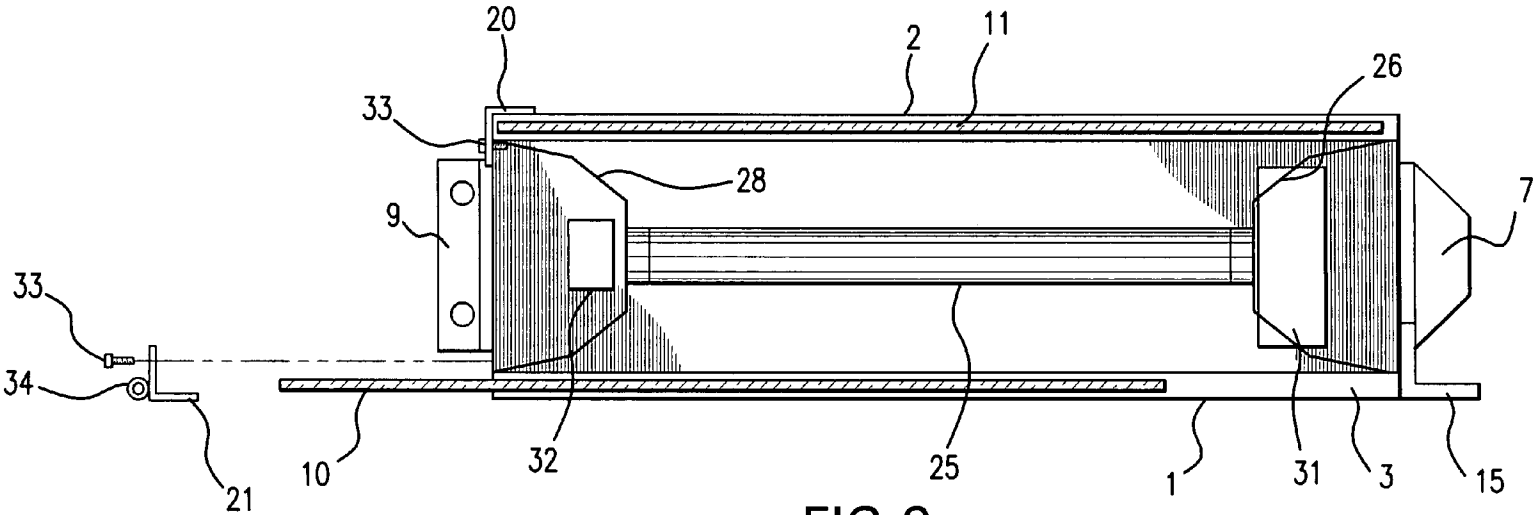
FIG. 9 is a schematic plan view, partially sectioned of the portion of the embodiment shown in FIG. 7.
Figure 9A:
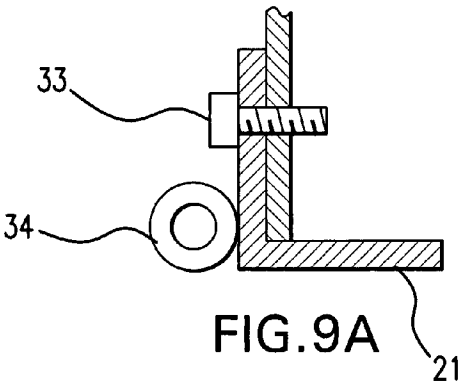
FIG. 9A is a detailed sectional view of a part of the portion of the embodiment shown in FIG. 9, when fully assembled.

The advertising display is illuminated from within by one or more light sources 25 (see FIGS. 7-9). The battery of the LSV that powers the engine preferably also powers each light source 25. Such a design, which depends on the powerful electric battery normally provided in this LSV class of vehicles, eliminates the need for an external generator to power the illumination. This mobile advertising system is operated without combustion emissions or generator noise.

The light source preferably includes, for example, a number of inexpensive and readily available fluorescent light tubes 25 in an array mounted between lighting mounts 26 and 28. A transformer 31, which converts the vehicle's battery power from DC to the AC required by the lighting array, is mounted between the lighting mount 26 and the front panel 5. A power cord 30 of the lighting array extends from the transformer 31 through a bushing 38 in the front panel 5 to plug into the power adapter 27 on the rear of the vehicle cab (see FIG. 1) for battery coupling. A lighting ballast 32 is preferably mounted onto lighting mount 28. The lighting array is easily accessible when the sign panels 10 or 11 are removed.

In an exemplary embodiment of the present invention, the advertising display system employs a low-speed electric vehicle defined as any four-wheeled electric vehicle with a top speed greater than 20 miles per hour but not greater than 25 miles per hour, and which complies with the federal safety standards established in 49 C.F.R. 571.500. The low-speed electric vehicle may be a vehicle popularly termed, among other things, an "alternative fueled vehicle," an "electric vehicle," or a "zero emission vehicle."

Also in an exemplary embodiment, the low-speed electric vehicle is provided with general dimensions not exceeding 6 feet in height, 13 feet in length, and 5 feet in width. It is equipped with a utility bed of a suitable width and length, with the bed preferably having a floor, and an advertising display assembly of a predetermined height and width removably connected to the utility bed in an upright position for message display. The advertising display assembly is removably connected to the utility bed in a flat stowed position for vehicle transport.

Preferably, the electrical power source for lighting the advertising display is integral to the low-speed electric vehicle, needing no external power source or generator during illumination. A plurality of translucent advertising panels are preferably provided, bearing advertising messages or other indicia. Each may be inserted into a track formed in the frame of the advertising display assembly in order to easily and quickly change the advertising message.

A plurality of light sources are preferably encased inside the advertising display assembly for illumination of the advertising panels. Preferably, a plurality of stabilizing mounting flanges are solidly attached to the advertising display frame; while a plurality of mounting brackets and/or sleeves are solidly attached to the advertising display assembly frame. Also, a plurality of receptacles or fasteners are solidly attached, preferably, to the bed of the low-speed electric vehicle.

This yields simple and inexpensive means of removably attaching the advertising display to the utility bed of the vehicle. The resulting Mobile Advertising System is mobile both in on-road and off-road conditions, causes little or no noise or air pollution, and operates as well at pedestrian-friendly speeds so as to promote a high level of interaction as to the message being advertised.

The advantages provided by the subject advertising display system in practice include:

- Quiet electric motor with no exhaust emission allows advertising in areas where idling or driving of gasoline or diesel vehicles would be intrusive—such as at retirement villages, indoor stadiums, historic districts, resorts, parks, and the like.
- Small size of the mobile advertising vehicle allows the message to be driven from streets off-road into parks or inside into convention centers.
- Mobile advertisement on a motorized pedestrian-speed zero-emission electric vehicle allows interaction with people regarding the advertising message.

Advertising frame can be easily attached to bed in viewing or storage positions.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and certain features like engaging or mated coupling elements may be reversed or interposed, all without departing from the spirit or scope of the invention as defined in the appended claims.

What is claimed is:

1. A mobile advertising display system comprising:

(a) a mobile platform having a bed surface;

(b) a reconfigurable display assembly disposed on said mobile platform for displacement relative thereto between at least first and second positions, said display assembly including at least one replaceable display panel, said display assembly in said first position maintaining said display panel transversely upright on said bed surface, and in said second position stowing said display panel in substantially overlaying manner over said bed surface; and, (c) at least first and second coupling assemblies for releasably locking said display assembly to said mobile platform respectively in said first and second positions, at least one of said first and second coupling assemblies including:

i. a flange portion extending from one of said display assembly and mobile platform, and a receptacle portion extending from the other of said display assembly and mobile platform for matedly receiving said flange portion; and, ii. first and second sleeve portions extending respectively from said display assembly and mobile platform for coaxially aligned securement one with the other.

2. The mobile advertising display system as recited in claim 1 wherein the other of said first and second coupling assemblies includes an engagement portion extending from one of said display assembly and mobile platform for mated engagement with one of said flange and receptacle portions extending from the other of said display assembly and mobile platform.

3. The mobile advertising display system as recited in claim 2 wherein each said receptacle portion is formed to extend from said mobile platform, and said flange and engagement portions are each formed to extend from said display assembly.

4. The mobile advertising display system as recited in claim 2 wherein the other of said first and second coupling assemblies further includes a mounting portion extending from one of said display assembly and mobile platform for fastener attachment to the other of said display assembly and mobile platform.

5. The mobile advertising display system as recited in claim 2 wherein said display assembly includes:

at least a pair of said display panels disposed on opposed sides thereof, each said display panel having a translucent portion; and, a light source disposed between said display panels for illuminating each said display panel.

6. The mobile advertising display system as recited in claim 5 wherein said display assembly further includes:

a frame defining a pair of slotted track peripheral portions slidably receiving respective ones of said display panels through an open end; and, a pair of retainer members detachably coupled to said frame for enclosing said open end, said retainer members respectively retaining said display panels in said peripheral portions of said frame.

7. The mobile advertising display system as recited in claim 6 wherein:

said frame of said display assembly includes front and back panels extending between to laterally space said display panels one from the other;

said receptacle portion is formed on said mobile platform; and, said flange and engagement portions are formed on said front panel for alternatively engaging said receptacle portion, said engagement portion being angularly offset in orientation from said flange portion.

8. The mobile advertising display system as recited in claim 7 wherein one of said flange and engagement portions is disposed adjacent a bottom lateral periphery of said front panel, and the other of said flange and engagement portions is disposed adjacent a longitudinal periphery of said front panel.

9. The mobile advertising display system as recited in claim 7 wherein a mounting portion extends from said back panel for fastener attachment to said mobile platform.

10. The mobile advertising display system as recited in claim 7 wherein a spaced pair of said first sleeve portions extends from at least one of said retainer members for coaxial securement to a respective pair of said second sleeve portions extending from said mobile platform.

11. The mobile advertising display system as recited in claim 1 wherein said bed surface is substantially planar, and said display assembly defines a substantially planar side face extending transversely upright from said bed surface in said first position; said substantially planar side face in said second position bearing substantially against said bed surface.

12. The mobile advertising display system as recited in claim 1 wherein said mobile platform includes a four-wheeled low-speed electric vehicle having a top speed rating within the approximate range of 20-25 miles per hour, said four-wheeled low-speed electric vehicle being compliant with federal safety standards specified in 49 C.F.R. 571.500.

13. The mobile advertising display system as recited in claim 12 wherein said four-wheeled low-speed electric vehicle is dimensionally within approximately 6 feet in a height parameter, 13 feet in a length parameter, and 5 feet in a width parameter.

14. A reconfigurable low-speed electric powered mobile advertising display system comprising:

(a) a low speed electric mobile platform having a utility bed surface, said mobile platform including at least first and second fixed coupling portions;

(b) a reconfigurable display assembly disposed on said mobile platform for displacement relative thereto between at least first and second positions, said display assembly including:

i. a frame;

ii. at least one replaceable display panel coupled to said frame to define therefor a substantially planar side face, said substantially planar side face in said first position extending transversely upright from said utility bed surface, and in said second position stowing in substantially flush manner against said utility bed surface;

iii. a pair of first coupling portions disposed on said frame offset one from the other for alternative mated engagement of said first fixed coupling portion when respectively in said first and second positions; and, iv. at least one second coupling portion for releasably locked securement to said second fixed coupling portion when in one of said first and second positions;

one of said display assembly and mobile platform including a mounting portion extending therefrom for fastener attachment to the other of said display assembly and mobile platform in one of said first and second positions.

15. The reconfigurable low-speed electric powered mobile advertising display system as recited in claim 14 wherein said first fixed coupling portion includes a receptacle member formed on said utility bed surface, and said first coupling portions of said display assembly each include a flange member extending from said frame for slidable insert into said receptacle member, said first coupling portions being mutually offset in angular orientation.

16. The reconfigurable low-speed electric powered mobile advertising display system as recited in claim 14 wherein said second coupling portion and said second fixed coupling portion include respective sleeve members for coaxially aligned securement one with the other.

17. The reconfigurable low-speed electric powered mobile advertising display system as recited in claim 14 wherein said display assembly further includes:

at least a pair of said display panels disposed on opposed sides thereof, each said display panel having a translucent portion; and, a light source disposed between said display panels for illuminating each said display panel.

18. The reconfigurable low-speed electric powered mobile advertising display system as recited in claim 17 wherein said frame of said display assembly defines a pair of slotted track peripheral portions slidably receiving respective ones of said display panels through an open end; and, a pair of retainer members detachably coupled to said frame for enclosing said open end, said retainer members respectively retaining said display panels in said peripheral portions of said frame.

19. A collapsible low-speed electric vehicle advertising display system comprising:

(a) a low speed electric vehicle having a utility bed surface, said vehicle having formed thereon at least one receptacle portion and at least one sleeve portion respectively disposed about said utility bed surface;

(b) a reconfigurable display assembly collapsibly disposed on said utility bed surface of said mobile platform for reconfiguration relative thereto between at least an upright position and a flat stowed position, said display assembly including:

i. a frame;

ii. at least one replaceable display panel coupled to said frame to define therefor a substantially planar side face, said substantially planar side face in said upright position extending transversely upward from said utility bed surface and in said flat stowed position overlaying said utility bed surface;

iii. a pair of flange portions disposed on said frame offset one from the other for alternative mated engagement of said receptacle portion when respectively in said upright and flat stowed positions; and, iv. at least one sleeve portion for releasably locked securement to said sleeve portion of said vehicle when in a first of said upright and flat stowed positions;

one of said display assembly and vehicle further including a mounting portion extending therefrom for fastener attachment to the other of said display assembly and mobile platform in a second of said upright and flat stowed positions.

20. The collapsible low-speed electric vehicle advertising display system as recited in claim 19 wherein:

(a) said display assembly further includes:

i. at least a pair of said display panels disposed on opposed sides thereof, each said display panel having a translucent portion; and, ii. a light source disposed between said display panels for illuminating each said display panel; and, (b) said frame of said display assembly defines a pair of slotted track peripheral portions slidably receiving respective ones of said display panels through an open end; and, a pair of retainer members each detachably coupled by a plurality of screw fasteners to said frame for enclosing said open end, said retainer members respectively retaining said display panels in said peripheral portions of said frame.

* * * * *